United States Patent [19]

Allier et al.

[11] 4,262,596

[45] Apr. 21, 1981

[54] OVERHEAD ATTACK MISSILE

[75] Inventors: Michel Allier, Garches; Didier Lursat, Limours, both of France

[73] Assignee: Societe Nationale Industrielle Aerospatiale, France

[21] Appl. No.: 952,427

[22] Filed: Oct. 18, 1978

[30] Foreign Application Priority Data

Oct. 18, 1977 [FR] France ..... 77 31279

[51] Int. Cl.[3] ..... F42B 13/30

[52] U.S. Cl. ..... 102/56 SC; 102/24 HC

[58] Field of Search ..... 102/24 HC, 56 SC

[56] References Cited

U.S. PATENT DOCUMENTS

| | | | |
|---|---|---|---|
| 3,732,818 | 5/1973 | Thomanek | 102/24 HC |
| 3,844,506 | 10/1974 | Stavis et al. | 244/3.15 |
| 3,995,574 | 12/1976 | Drimmer | 114/20 R |
| 3,998,162 | 12/1976 | Forrest et al. | 102/56 SC |
| 4,026,211 | 5/1977 | Ostling | 102/24 HC |
| 4,109,576 | 8/1978 | Eckels | 102/24 HC |

FOREIGN PATENT DOCUMENTS

| | | | |
|---|---|---|---|
| 1453815 | 6/1970 | Fed. Rep. of Germany . | |
| 2112698 | 3/1971 | Fed. Rep. of Germany | 244/3.15 |
| 2612327 | 10/1976 | Fed. Rep. of Germany . | |
| 2845414 | 4/1979 | Fed. Rep. of Germany | 102/56 SC |
| 1036337 | 6/1966 | United Kingdom . | |
| 1298931 | 12/1972 | United Kingdom . | |

OTHER PUBLICATIONS

Sigley et al., AERO Digest, vol. 73, No. 1, Jul. 1956, pp. 22–31.

*Primary Examiner*—Leland A. Sebastian

*Attorney, Agent, or Firm*—Karl W. Flocks

[57] ABSTRACT

A overhead attack missile for targets of little movement such as tanks or firing turrets is described. It comprises: at least one hollow charge, with a unidirectional radial action possessing a pyrotechnic dissymmetry means such as the off-centering of the detonator of the charge to preserve the straightness of the burst despite the movement of the missile and a guidance means to bring the missile, at the end its course, overhead of the target. The invention is applied to any stabilized or unmanned aerial weapons carrying war heads.

6 Claims, 4 Drawing Figures

FIG. 2
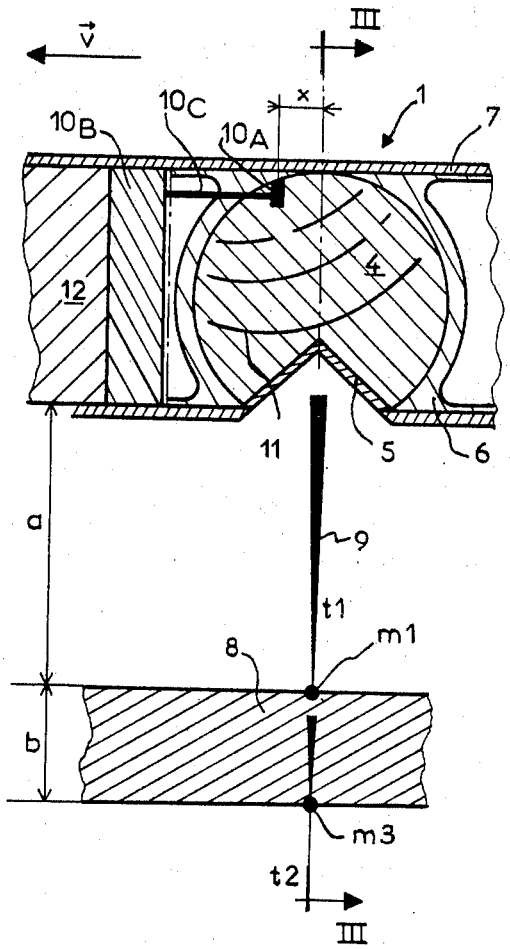
FIG. 3
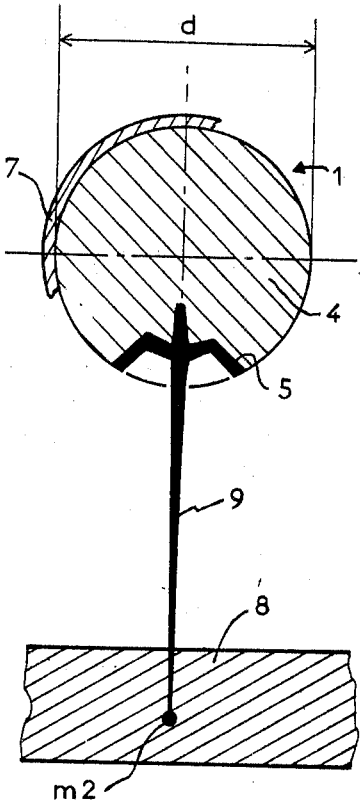
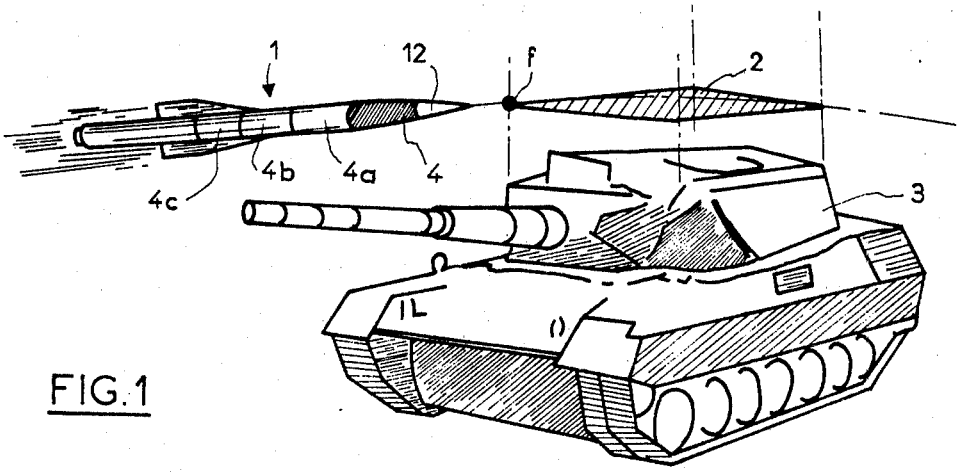
FIG. 1

OVERHEAD ATTACK MISSILE

BACKGROUND OF THE INVENTION

1. Field of the Invention

The present invention relates to hollow charges generally and is concerned more particularly with the field in which the latter are used against targets of little mobility such as tanks, for example, or again against firing turrets.

2. Description of the Prior Art

The front and the side portions of tanks have, of course, had to be reinforced through the increasing penetration power of perforating charges acting by direct firing and this, to the detriment of the remaining useful mass of armour plating.

This is particularly clear on armoured vehicles where the upper or summit parts can only, for a given motorized power, be protected against the effects of explosions, consequently a relatively light-armour on these regions is judged risky. To reach these summit portions various means may be contemplated.

The projectile can include a charge with a multidirectional perforating effect like that indicated in French Pat. No. 1 604 910 and No. 1 604 968 as well as in U.S. Pat. No. 3,977,330.

Unfortunately, in such multidirectional charges, the concentration of power for a single burst taken among others, is not sufficient to assure the perforation of the summit armour plate of a tank, for example, which represents however more than 20% of the 300 to 400 mm of front or lateral armour plate.

Another solution consists of making the missile pass above the target and then to make it tilt suddenly so that the axial effect of the shaped charge can be produced perpendicularly to the trajectory.

Taking into account the fact that, in such an operation, the shaped or hollow charge must pass through, if necessary, the whole compartment containing, among other things, the auto-guidance mechanism which is located in the front of the missile before affecting the target, it is obvious that the perforating power will be reduced thereby.

It is an object of the present invention to provide an overhead attack missile which avoids the drawbacks mentioned in preceding paragraphs.

Other objects and advantages will appear from the description which follows.

GENERAL DESCRIPTION OF THE INVENTION

According to the invention a novel application of hollow charges with a unidirectional radial action, already used in the field of petroleum prospecting and geology and described, for example, in U.S. Pat. No. 2,667,836 taken from among many others, is applied to this field of military action.

However the transposition of these techniques within the field concerned in the invention raises the problem of the mobility of the missile with respect to the target, hence the rectitude or straightness of the burst or blast of the hollow charge during the perforation.

In the remainder of the present description, the term missile must be taken in its widest sense and encompasses therefore a stabilized and unmanned aerial weapon carrying military charges such as finned-shells, rockets, drones, R.P.V. (remotely piloted vehicle) and variants of weapon-targets.

In fact, prior art techniques made use of shaped charges immobile with respect to the target and hence of zero relative speed between these two elements and consequently a perfectly rectilineal burst.

In the case where the charge is moved at a relatively high speed with respect to the target, the burst can have a characteristic curved shape which must then, in order to maintain effectiveness, be compensated by pyrotechnic means applied to the shaped charge itself.

The first means applied in the present invention therefore consists of defining the pyrotechnic correction conditions that the hollow charge must present as a function of the various parameters encountered such as: relative speeds, charge-target distance and position as well as the depth of penetration required in the armour plating.

The second means, which is the corollary of the first means, consists of determining the ballistic conditions under which the missile must be presented to make the shaped charge with the unidirectional radial action act suitably on the summit portion of the target.

The invention will in any case be well understood from the following description which will give, with the help of the accompanying drawings, the embodiment which is best adapted to render the invention optimal in operation.

BRIEF DESCRIPTION OF THE DRAWINGS

In the drawings:

FIG. 1 is a perspective view showing the summit mode of action according to the invention, of a missile with a unidirectional radial hollow charge against a tank;

FIG. 2 is a diagrammatic axial section of a missile showing a characteristic pyrotechnic correction means of the charge during its movement;

FIG. 3 is a radial diagrammatic section made along the line III—III of the FIG. 2;

DESCRIPTION OF A PREFERRED EMBODIMENT

Figure 4:
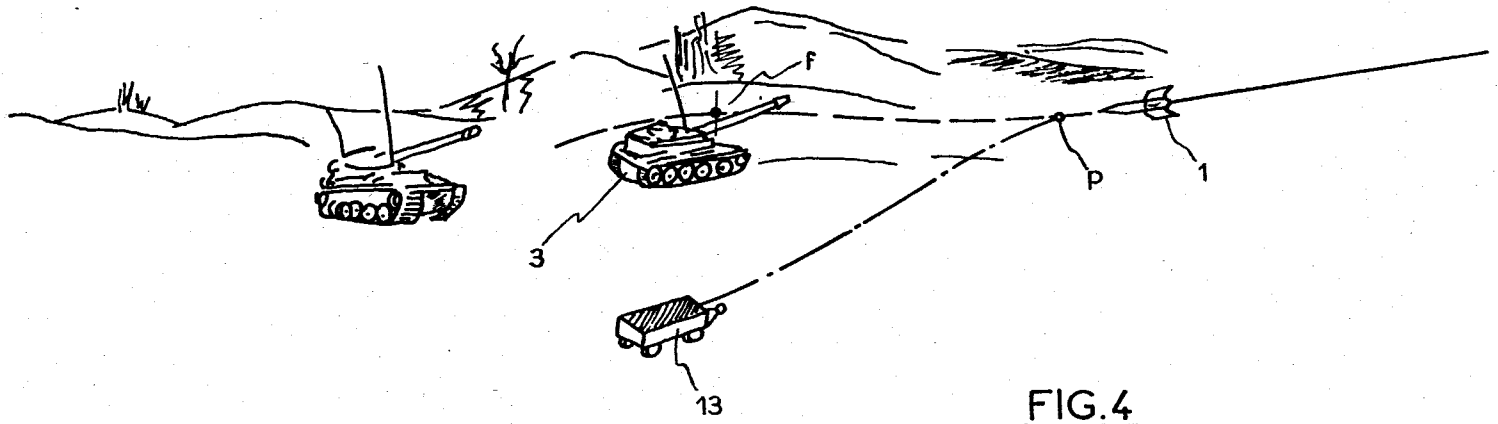
FIG. 4 is a perspective view showing the process firing the missile against a tank.

Referring to FIG. 1, it is seen that the stabilized and guided missle 1 must be brought into the summit region 2 of the target represented in the present case by tank 3, so that unidirectional radial action of the charge can be applied according to the invention.

This mode of action shown diagrammatically in FIGS. 2 and 3 results from the adaptation of numerous parameters and represents, in fact, the essential means used in the invention.

It must further be recalled, as is mentioned moveover in "The Sciences of High Explosives" of Melin Cook, American Chemical Society, Chapman and Hall, and in the U.S. Pat. No. 3,675,575, the penetration b into the target, produced by a shaped charge is given by the classic expression:

$$b = l[\lambda \rho_J / \rho_c]^{\frac{1}{2}}$$

in which:

l is the effective length of the burst $\rho_J$ is the density of the burst $\rho_c$ is the density of the target $\lambda$ equals 1 in practice.

Without going into considerations relating to cases which are always particular, from the fact of the adaptation of the above terms, it must, in addition, be indicated that the distance a, charge-target or "standoff" is customariy of the order of 4 to 8 times the diameter d of the shaped charge.

Under the conditions of operation according to the invention and with reference to FIGS. 2 and 3, the missile indicated as a whole at 1 carries an adapted hollow charge such as charge 4 in the present example with its cone 5 and the charge is contained in an envelope 6 fast to the outer structure 7. The action of the charge 4 is radial and unidirectional and the burst 9 is directed at the target 8 as will appear from examination of these Figures.

The pyrotechnic correction of the charge is obtained in the present case by an off-centering of the igniter $\mathbf{10}_A$ of an amount x which depends on the parameters which will be discussed below.

This correction can moveover be realized by any suitable means but that used in the present description is derived from a fault in the symmetry of detonation which had moveover been observed as undesirable in the French Pat. No. 1,124,550 where it was proposed to apply a remedy therefor.

In the embodiment of the invention which is suggested here, the excentric igniter $\mathbf{10}_A$ produces a detonation wave whose lines of force 11 result in a deflection of the burst in a direction opposite to its excentring so that, according to the representation in FIG. 2, the burst becomes thrown to the right.

The complete development of the operation is carried on the following manner:

The missile 1 carrying the hollow charge 4 and passing at the distance a from the target 8, at the speed $\vec{v}$ produces the firing at the moment $t_0$, from a triggering device $\mathbf{10}_B$ connected to the detonation $\mathbf{10}_A$ by a connection $\mathbf{10}_c$.

At the moment t1, the head of the burst effectively reaches the target of the point m1 and the following elements of this burst must be kept substantially at this same point of impact until the moment t2 when the point m3 corresponding to the perforation of the armour plate is passed.

This is obtained by the pyrotechnic dissymmetry of the shaped charge which permits on the implosion of the covering 5 the straightness of the burst with respect to the target, in a way to be maintained, and this, inspite of the movement of the missile.

By way of example, if it is considered that the missile 1 is driven with a speed $\vec{v}$ of the order of 550 m/s and that the head of the burst itself possesses a speed of the order of 8000 m/s, the armour 8 is perforated from the point m1 to the point m3 during the same hundredth of a $\mu$s that the burst lasts.

FIG. 3 shows the caracteristic shape of the burst 9 whilst the perforation is at half-way point m2.

In addition, it will recalled that the effectiveness of the missiles carrying a hollow charge with an axial action is found to be particularly diminished by the presence of equipment arranged in front of the charges, such as, for example, the self-guidance device.

It is, on the other hand, easy to see that, in the invention, the front portion of the missile can be occupied by an equipment housing 12 without this effectiveness becoming affected which means that the position of the charge of the missile is indifferent.

As is seen in FIG. 1, the missile 1 may be equipped with a plurality of hollow charges 4, 4*a*, 4*b*, 4*c* operating as has been stated above in a manner so as to increase the number of points of penetration and/or the probability of reaching the summit region 2.

The complete firing sequence is carried out under the conditions below with reference to FIGS. 1 and 4.

The missile 1 is brought into the immediate vicinity of the sighted target 3 up to the point P, by any suitable guidance means.

Any automatic remote control system adopted on many weapon systems, such as for instance the missiles of the Harpon Weapon System of Aerospatiale Company of France involving a pointing device, an infra-red or electromagnetic system for detecting the missile with respect to the pointing axis, and a computer on the ground to transform angular deviations with respect to the pointing axis and to generate remote control commands to bring the missile back to an axis parallel to the pointing axis. More particularly the missiles are guided within a cylindrical corridor of a small diameter, the axis of which is parallel to the pointing axis and at a fixed distance therefrom due to generation of commands. Also included is a system for transmission to the missile of commands generated on the ground, either through wires or electromagnetic waves.

Such guidance systems which can be used with the present invention may be found in U.S. Pat. No. 3,672,607 of Stauff et al issued June 27, 1972 and entitled "Sighting Telescope Infra-red Direction Finder Unit in a Teleguiding Device for Missiles" and in U.S. Pat. No. 2,856,852 of Hinman, Jr. et al issued Oct. 21, 1958 and entitled "Proximity Fuse". The guidance system according to U.S. Pat. No. 3,672,607 can bring the missile in the direction of the target within a cylindrical corridor having an axis parallel to the pointing axis. The missile is directed to the target so that the cylindrical corridor passes above the target. Moreover the missile is provided with a proximity fuse, for instance, of a type described in U.S. Pat. No. 2,856,852 which is set to trigger the missile when the missile passes above the target.

Additional guidance systems which can be used with the present invention may also be found in U.S. Pat. No. 3,406,402 of Stauff et al entitled "Optical Aiming Device" and U.S. Pat. No. 3,293,985 of Stauff et al entitled "Firing Turret for Teleguided Missiles".

At the moment when missile 1 reaches the immediate vicinity of target 3, a proximity fuse is activated and the members themselves of the missile enable it to reach the point f where the hollow charge is primed in order that the firing can take place as soon as there is penetration into the summit region 2.

Means are also provided so that the missile 1 is not directed onto "lures" or "decoys" 13 of no interest and so that, only the target 3 is sighted to the exclusion of any other.

It is obvious also that the detection means used in this proximity fuse are known in themselves and so will not be described more fully in the present description.

The shaped charge at present used possesses an optimal effect when it is of conical type with a certain pyrotechnic dissymmetry such as been described above.

When the size of the charge borne by the missile is sufficiently great with respect to the armour plating to be pierced, it may utilize a charge of the dihedral type.

In conclusion, the invention results in the conjoint application to a missile of two means, the one pyrotechnic adapted to determine the parameters governing, by pyrotechnic dissymmetry of the detonation waves of a shaped charge, the straightness of a radial burst acting unidirectionally, the other, the conditions of conducting the firing of the charge-bearing missile, and it is quite obvious, in this spirit, that any adaptation which would be made of the invention to arrive at the same result, would remain within its scope defined by the accompanying claims.

We claim:

1. A guided missile capable of passing at a known distance from a target at a known speed while being corrected in rolling for overhead attack particularly against slow targets such as tanks or firing turrets comprising at least one hollow charge in the guided missile for detonation over the summit region of the target including means to direct the force of said charge in a radial, unidirectional manner, triggering means in the missile to initiate detonation of said hollow charge at a point in time for the head of the burst to effectively reach the target on a calculated spot, pyrotechnical dissymmetry means connected to said triggering means and located with said hollow charge to act on detonation waves to preserve the straightness of the burst to the target despite movement of the missile to cause succeeding elements of the burst to hit substantially the same impact point until at least the time when perforation of the armored plating has been passed.

2. The guided missile for overhead attack according to claim 1, further characterized by additional hollow charges carried by the missile with each of said additional hollow charges having means to direct the force of said charge in a radial, unidirectional manner.

3. The guided missile for overhead attack according to claim 1, further characterized by said charge being of the dihedral type.

4. The guided missile for overhead attack according to claim 1, further characterized by guiding and detecting means in the missile being of the type employed in an anti-tank weapon system.

5. The guided missile for overhead attack according to claim 1, further characterized by said means to direct the force has a conical shape faced toward the target.

6. The guided missile for overhead attack according to claim 1, further characterized by said pyrotechnical dissymmetry means being an eccentric igniter.

* * * * *